United States Patent [19]

Johnston

[11] 3,990,197

[45] Nov. 9, 1976

[54] LIFTABLE WOODEN FRAME BUILDING UNIT AND METHOD OF CONSTRUCTION

[75] Inventor: Clifford V. Johnston, Columbus, Ohio

[73] Assignee: Cardinal Industries Incorporated, Columbus, Ohio

[22] Filed: Mar. 15, 1976

[21] Appl. No.: 666,968

[52] U.S. Cl. ..... 52/125; 52/79; 52/90; 52/745

[51] Int. Cl.[2] ..... E04B 5/58; E04H 1/12; E04G 21/14

[58] Field of Search ..... 52/125, 122, 79, 90, 52/745, 143; 214/1 H, 38 CA; 294/67 R, 67 DA

[56] References Cited

UNITED STATES PATENTS

| | | | |
|---|---|---|---|
| 3,103,709 | 9/1963 | Bolt | 52/79 X |
| 3,348,344 | 10/1967 | Tatevossian | 52/79 X |
| 3,683,571 | 8/1972 | Walz | 52/125 |

FOREIGN PATENTS OR APPLICATIONS

| | | | |
|---|---|---|---|
| 1,215,814 | 11/1959 | France | 52/125 |

*Primary Examiner*—J. Karl Bell

*Attorney, Agent, or Firm*—William S. Rambo

[57] ABSTRACT

A building unit which includes side walls having the usual vertical studs and having a roof structure attached thereto, the entire unit being liftable by flexible straps extended above the roof structure. The roof structure is attached to the side walls so that lifting forces will be distributed more or less uniformly throughout the structure to prevent separation of the roof from the side walls during lifting of the building unit.

8 Claims, 4 Drawing Figures

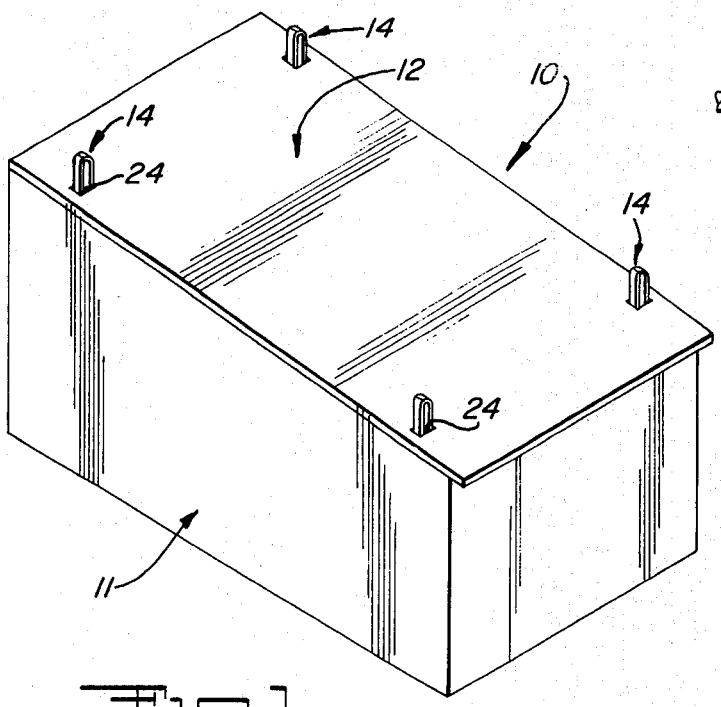
Fig 1
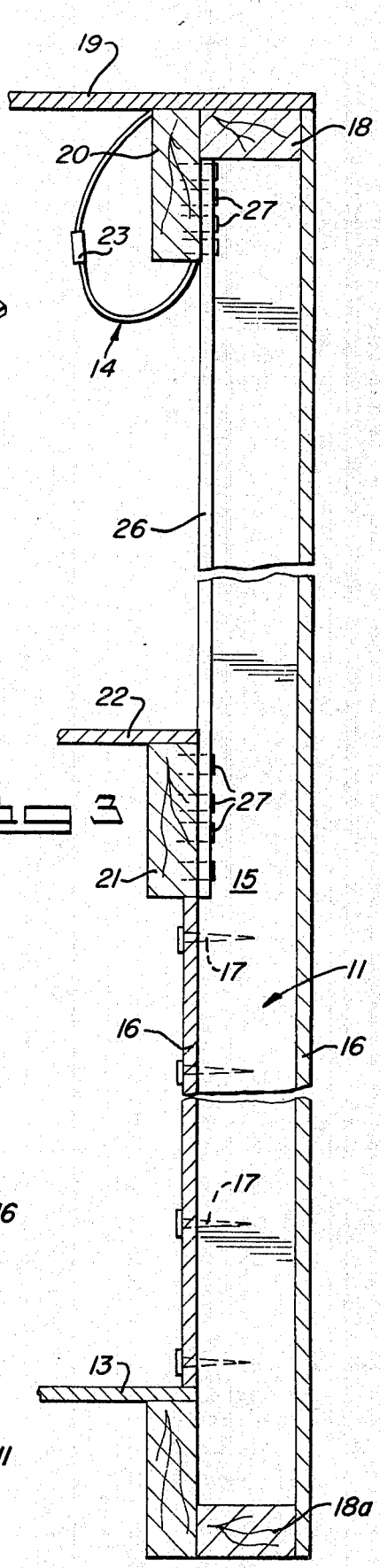
Fig 3
Fig 4
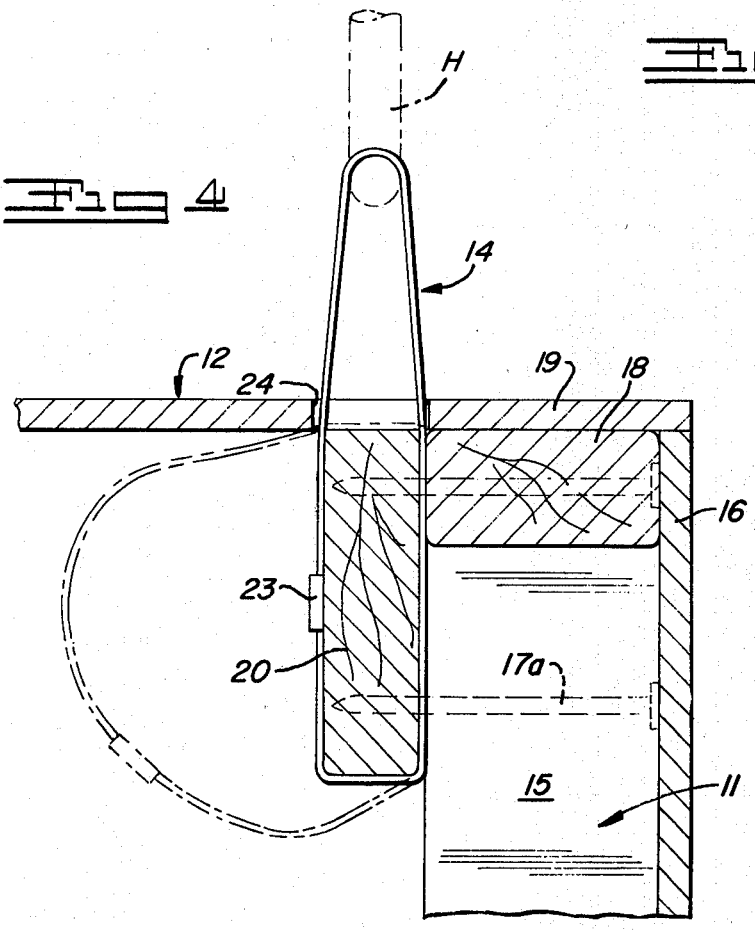

LIFTABLE WOODEN FRAME BUILDING UNIT AND METHOD OF CONSTRUCTION

BACKGROUND AND SUMMARY OF THE INVENTION

Prefabricated or factory constructed building modules or units are at present lifted into place on their receiving foundation usually by means of a crane having a lift frame with hooks at four lift points which engage lifting straps adjacent the four corners of the respective units. These hooks usually engage lift straps which must be passed completely around the girth of the unit which requires very long straps and considerable time in applying and removing the straps as well as increases the possibility of damage to the unit.

The present invention provides a unit or module which has a wood frame including the usual vertical studs for the vertical walls and has a roof structure attached thereto. According to this invention, lifting members are operatively attached to the roof structure to extend thereabove adjacent its four corners, so that the hooks of the lifting frame can be engaged therewith to lift the entire unit. Furthermore, according to this invention, the roof structure is connected to the studs of the vertical walls by means which insures that the lifting forces will be distributed throughout those walls and that there will be no separation of the roof structure from the vertical walls because of such lifting forces.

BRIEF DESCRIPTION OF THE DRAWINGS

The best mode contemplated in carrying out this invention is illustrated in the accompanying drawings in which:

FIG. 1 is a schematic perspective view of a building module in which this invention is embodied.

FIG. 3 is an enlarged vertical sectional view taken along line 3 — 3 of FIG. 2.

FIG. 4 is an enlarged vertical sectional view taken along line 4 — 4 of FIG. 2.

DETAILED DESCRIPTION OF THE INVENTION

Figure 2:
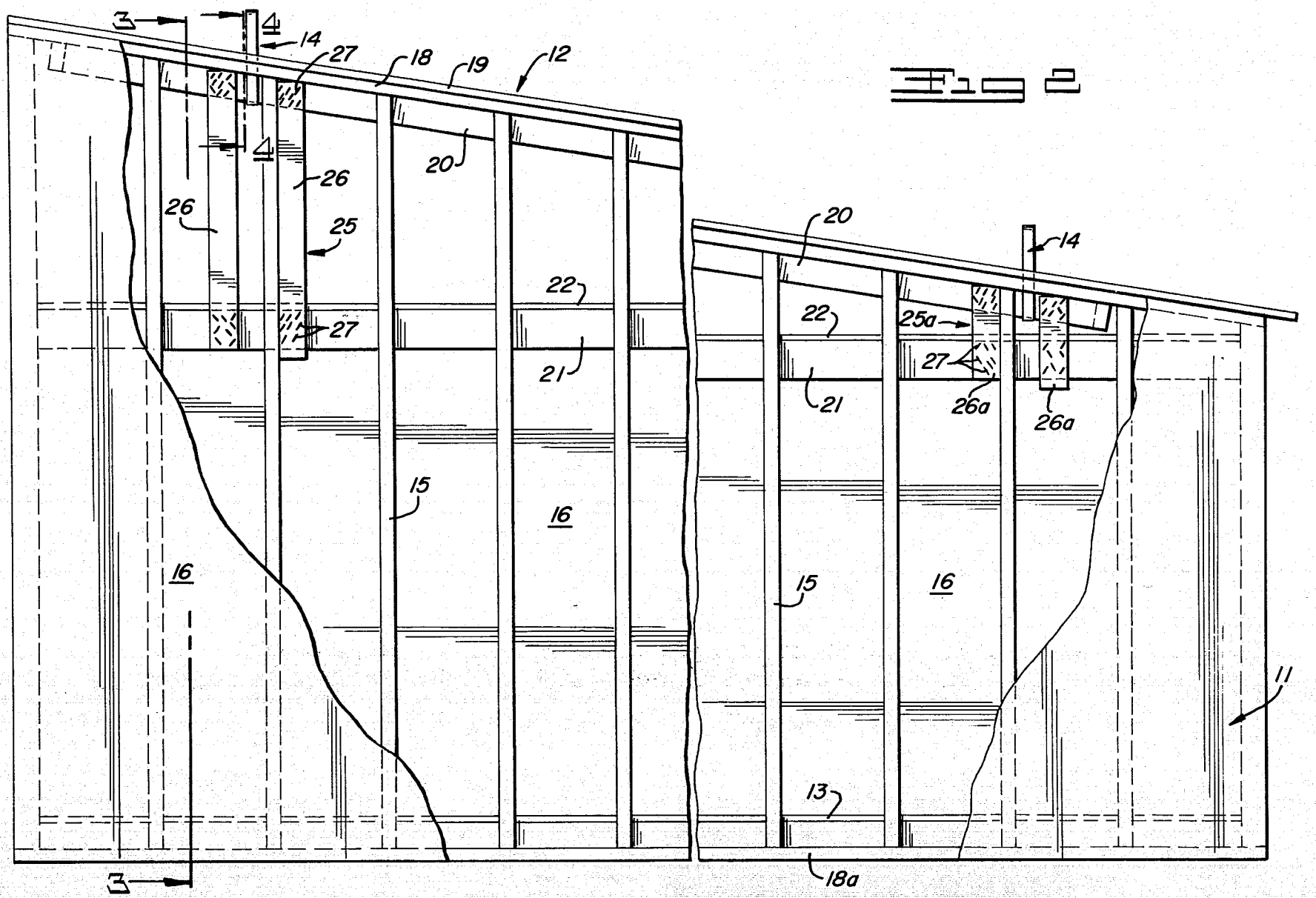
FIG. 2 is a side elevational view, with part of the sheathing cut away, to show the framework having the present invention incorporated therein.

This invention is applicable to various forms of building units or modules which have a wooden frame and, by way of example, the module 10 is illustrated generally in FIG. 1. It has vertically disposed side and end walls designated generally by the numeral 11 and a roof structure designated generally by the numeral 12, the roof structure shown being of the shed or sloping type. The module includes the usual floor structure which is not shown in FIG. 1, but is indicated at 13 in FIG. 3. The roof structure, according to this invention, has lifting members 14, shown extended through the roof adjacent each of the four corners of the module by means of which it may be lifted. Details of the module are illustrated in FIGS. 2 to 4.

Each vertical side wall or end wall 11 includes the usual properly-spaced vertical studs 15. Sheet material 16 is applied to the studs on their inner or outer edges or both, and, in the example shown, it is secured both inside and outside the studding preferably by nails 17 as well as by glue. Usually, the inner wall sheet material 16 is drywall or plasterboard and the outer sheet material is plywood, but it is to be understood that according to this invention any sheet material can be used as long as it has sufficient web strength. A top plate 18 is fastened to the upper ends of the studs in the usual manner.

The roof 12 includes the usual roof band which, in this example, is illustrated as including structural members such as support beams or rafters 20 that may support plywood or other roof sheathing 19 which is extended over the top plate 18 and is preferably nailed and glued thereto. Other rafters not shown are provided intermediate the ones shown adjacent the vertical walls 11. As shown, the rafter 20 extends at a slightly inclined angle across the upper ends of the studs 15 and is securely attached to each stud, preferably by large (forty penny) nails 17*a* (see FIG. 4). The rafter 20 of the roof band is also nailed to the plate 18. It will be understood that the studs 15 are of unequal height to provide the slope in the roof structure. The wall 11 also includes the usual base plate 18*a* on which the studs rest and to which they are secured in the usual manner.

The vertical walls 11 also have attached thereto a ceiling band or beam 21. Each beam 21 extends across the studs 15 and is attached to each stud, preferably by large nails similar to the manner of attaching the roof band member 20 to the studs. The ceiling band member 21 is disposed in horizontal position above the inner drywall sheets 16 (FIG. 3) and may support a ceiling of suitable type, indicated generally at 22. It is located at a level below the associated roof band or rafter member 20.

As previously indicated, the module 10 is arranged to be lifted solely by the lifting strap members 14. Each of the members 14 preferably takes the form of a flexible steel tape or band which is passed completely vertically around the rafter 20 and the ends thereof are then joined together, as at 23, by means of a conventional strap-clinching or baling tool to form an endless, flexible loop adjacent each corner of the building module. The roof sheathing 19 is also formed in the region of the strap members 14 with openings 24 to permit extension of the strap members 14 therethrough. Each member 14 is sufficiently flexible so that, after the module has been transported to and erected on its foundation, it can be pushed or retracted to a concealed position beneath the upper surface of the roof, as indicated by broken lines in FIG. 4. If desired, the lifting straps 14 may take the form of closed loops of flexible cable which may be extended above or retracted below the roof. Regardless of their specific form, the lifting straps 14, when extended, can be readily engaged by a lifting hook or hoist H as indicated by broken lines in FIG. 4.

The building module 10 can be lifted and transported by hooking into the four extended loop members 14. However, with prior art frame structures the lifting forces, to lift the entire module or unit, would be transmitted from the structural members 20, through the nailed connections of the members to the vertical walls 11, specifically being concentrated at the nailed connections located at the upper ends of the studs 15. Therefore, the weight of the structure, suspended by the studs, would cause the roof to separate from the vertical walls and be lifted therefrom. To avoid this, a special connecting structure is provided, according to the present invention, between the roof 12 and the vertical walls 11, so that instead of concentrating the lifting forces at the upper ends of the studs 15, it is distributed throughout the vertical walls 11. This arrangement includes a connection indicated generally by numerals 25 and 25*a*, located adjacent the respective lifting loops 14, for transmitting tensile forces from the structural beam member 20 to the structural beam member 21 located therebelow.

These connections are indicated best in FIGS. 2 and 3, and it will be understood that the only differences between connections, is that the two numbered 25 at the front or higher end of the module are of greater vertical extent than the two numbered 25*a* at the rear or lower end of the module.

Each tension-transmitting connection, includes a pair of tension members which are located at opposite sides, that is fore and aft, of the vertical plane in which the respective lifting loop 14 is disposed. It will be noted that the beam 21 extends longitudinally the full length of the module and that the beam or rafter 20 extends longitudinally substantially the full length thereof. The forward tension members are numbered 26 and the rear tension members are numbered 26*a*. These members may be of various materials but it is preferred to use strips of plywood which have the direction of the grain longitudinally of the strips or vertically of the structure. Each pair is disposed in plumb parallel relationship as indicated best in FIG. 2. The upper ends of the respective strips are fastened to the face of the member 20, which they overlap, and the lower ends of those strips are fastened to the corresponding face of the member 21 which they overlap. Preferably, the fastening is by a plurality of staples 27. It will be noted that the vertically disposed tension-transmitting strips are attached to the outer face of beam 20 below the plate 18 and to the corresponding outer face of the beam 21. It will also be noted that these strips are located in the spaces between adjacent studs.

Thus, when lifting forces are applied to the extended lifting loops 14, the lifting forces will be transmitted to the beams or rafters 20, and then through the tension-transmitting connections 25 and 25*a* to the beams 21. Some of the lifting forces will be transmitted directly to the upper ends of the studs 15 but the greater part of the forces will be transmitted to the vertical side walls 11 through the connections 25 and 25*a* and the beams 21 which are connected to the studs 15 of the side walls 11. The sheets 16 on the inner and outer sides of the walls will provide webs which are attached to the studs in such a manner that they cooperate structurally therewith to provide a diaphragm action that spreads the lifting load throughout the vertical wall structures. This would be true even though the drywall 16 only was used and extended only up to the ceiling band 21, since the connections 25 and 25*a* extend on upwardly to the roof band 20, as shown best in FIG. 3.

After the lifting frame with its four hooks H engaged with the four extended loops 14, is used to lift the module 10 and place it on its foundation, the hooks may be disengaged from the loops and they may then be pushed downwardly through the respective openings 24 to retracted positions below the upper surface of the roof sheathing 19. The openings 24 may then be sealed, for example, by replacing flexible shingle portions (not shown) on the sheathing 19 which were previously displaced to permit extension of the loops above the roof surface.

It will be apparent that this invention provides a liftable building unit, having a wooden frame with the usual vertical studs, which can be lifted by the roof structure by lifting members extended thereabove. The roof structure includes beams or rafters which extend substantially the full length of opposed vertical walls which include the studs, the beams being secured to the studs adjacent their upper ends. In addition, below each roof beam at the respectively opposed vertical walls, another longitudinally extending structural member or beam is fastened to the respective studs of the wall. Between the superimposed beams or structural members, which are both connected to the studs as indicated, tension members are connected therebetween adjacent the ends of such beams where the lifting members are also operatively connected to the roof beams. With this arrangement, there is no danger of the roof separating from the vertical walls at the upper ends of the studs. Also, the provision of sheets of material of good web strength on at least one side of the studs of the respective vertical walls, with the sheets securely fastened to the edges of the studs, results in a diaphragm effect for further distributing the lifting forces throughout the vertical walls.

Having thus described the invention, what is claimed is:

1. A liftable building unit of wooden-frame construction having opposed spaced vertical walls including vertical studs and a roof structure attached to the vertical studs, said roof structure including longitudinally extending beam members disposed at the respective walls with each extending crosswise of the studs of the wall at their upper ends and attached thereto, a second beam member at each vertical wall spaced below the first beam member extending longitudinally crosswise of the studs and connected thereto, tension members extending vertically between the two vertically spaced beam members and attached to both beam members adjacent their ends for transmitting lifting force from the roof beam member to the lower second beam member at the respective wall, and lifting means operatively connected to the longitudinally extending roof beam members of the respective walls adjacent their ends to provide lifting points for the entire unit.

2. A liftable building unit according to claim 1 in which each of said vertical walls includes sheet material attached to at least one edge of the studs to provide a diaphragm effect to distribute the lifting forces throughout the wall.

3. A liftable building unit according to claim 1 in which the lifting means is in the form of lifting members operatively connected to the roof beams and movable from extended positions above the roof structure to retracted positions within the roof structure.

4. A liftable building unit according to claim 1 in which the tension members are disposed adjacent each lifting member.

5. A liftable building unit according to claim 1 in which the roof structure and its beam members are attached to the studs of the walls in sloping position, and wherein said second beams are horizontally disposed at a lower level to provide part of a ceiling support band.

6. A liftable building unit according to claim 3 in which the lifting members are flexible loops passed around the roof beams.

7. A liftable building unit according to claim 4 in which the tension members are provided as a pair of members with the members of the pair on opposite sides of each of the lifting members.

8. The method of making a wood frame building liftable which comprises:

a. forming vertical walls for said building with relatively spaced apart, vertical studs and inner and outer sheeting extending between and connecting adjacent studs;

b. connecting a roof-supporting beam to the upper ends of said studs and a floor supporting beam to the lower ends of said studs;

c. connecting a generally horizontal ceiling-supporting beam to said studs a distance below said roof-supporting beam;

d. applying upwardly extensible lift strips near the opposite ends of said roof-supporting beam; and e. connecting a pair of tension members between said roof-supporting beam and said ceiling-supporting beam along each side of each lift strap.

* * * * *